US008807227B2

(12) United States Patent
Fould et al.

(10) Patent No.: US 8,807,227 B2
(45) Date of Patent: Aug. 19, 2014

(54) METHOD AND APPARATUS FOR PRESSURE TESTING A TUBULAR BODY

(75) Inventors: Jeremie Fould, Courbevoie (FR); Joel Rondeau, Antony (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 245 days.

(21) Appl. No.: 13/330,278

(22) Filed: Dec. 19, 2011

(65) Prior Publication Data

US 2012/0160488 A1 Jun. 28, 2012

Related U.S. Application Data

(60) Provisional application No. 61/427,277, filed on Dec. 27, 2010.

(51) Int. Cl.

| | |
|---|---|
| ***E21B 34/06*** | (2006.01) |
| ***E21B 34/10*** | (2006.01) |
| ***E21B 47/10*** | (2012.01) |
| ***E21B 23/00*** | (2006.01) |

(52) U.S. Cl.

CPC ..... *E21B 47/10* (2013.01); *E21B 23/004* (2013.01)

USPC .... 166/373; 166/318; 166/250.08; 166/177.4

(58) Field of Classification Search

USPC ..... 166/285, 155, 177.4, 318, 250.08, 193; 137/624.27, 871, 71, 533.11; 73/49.1

See application file for complete search history.

(56) References Cited

U.S. PATENT DOCUMENTS

| | | | | | |
|---|---|---|---|---|---|
| 3,995,692 | A * | 12/1976 | Seitz | 166/318 |
| 4,100,969 | A * | 7/1978 | Randermann, Jr. | 166/324 |
| 4,979,568 | A * | 12/1990 | Spencer et al. | 166/374 |
| 5,609,178 | A * | 3/1997 | Hennig et al. | 137/10 |
| 6,102,060 | A * | 8/2000 | Howlett et al. | 137/1 |
| 8,403,067 | B2 * | 3/2013 | Knobloch et al. | 166/386 |
| 2010/0132954 | A1 * | 6/2010 | Telfer | 166/373 |
| 2011/0226491 | A1 * | 9/2011 | Telfer | 166/384 |
| 2012/0043093 | A1 * | 2/2012 | Cravatte | 166/376 |
| 2012/0055681 | A1 * | 3/2012 | Telfer | 166/373 |

OTHER PUBLICATIONS

Hyne, Norman J. (2001). Nontechnical Guide to Petroleum Geology, Exploration, Drilling, and Production (2nd Edition). PennWell.*

* cited by examiner

*Primary Examiner* — Kenneth L Thompson
*Assistant Examiner* — Steven MacDonald
(74) *Attorney, Agent, or Firm* — Michael Dae

(57) ABSTRACT

An apparatus for pressure-testing a tubular body may be installed in the tubular-body interior. The apparatus comprises an activation-device seat, one or more bypass ports, a J-slot with an indexing pin and a spring. When an activation device, for example a ball, lands in the activation-device seat, fluid communication through the tubular body is blocked, allowing pressurization. During pressurization, the activation-device seat moves downward, causing the spring to compress and the indexing pin in the J-slot to move to the bottom position. Upon depressurization after the test, the activation-device seat moves upward, causing to spring to decompress and the indexing pin the J-slot to move to the top position. Upward movement of the activation-device seat unblocks the bypass ports, thereby reestablishing fluid communication through the tubular body. The tubular body may be drillpipe, casing or coiled tubing that is installed in the borehole of a subterranean well.

18 Claims, 4 Drawing Sheets

METHOD AND APPARATUS FOR PRESSURE TESTING A TUBULAR BODY

CROSS-REFERENCED APPLICATIONS

This application claims the benefit of the disclosure of U.S. provisional application No. 61/427,277 incorporated by reference in its entirety.

BACKGROUND

The statements in this section merely provide background information related to the present disclosure and may not constitute prior art.

This disclosure relates to methods and apparatuses for pressure testing tubular bodies, for example casing or tubing strings installed in subterranean wells.

During the construction of subterranean wells, it is common, during and after drilling, to place a tubular body in the wellbore. The tubular body may comprise drillpipe, casing, liner, coiled tubing or combinations thereof. The purpose of the tubular body is to act as a conduit through which desirable fluids from the well may travel and be collected. The tubular body is normally secured in the well by a cement sheath. The cement sheath provides mechanical support and hydraulic isolation between the zones or layers that the well penetrates. The latter function is important because it prevents hydraulic communication between zones that may result in contamination. For example, the cement sheath blocks fluids from oil or gas zones from entering the water table and polluting drinking water. In addition, to optimize a well's production efficiency, it may be desirable to isolate, for example, a gas-producing zone from an oil-producing zone.

Conventionally, production tubing is placed inside the casing in the vicinity of the zone from which hydrocarbons are extracted. The production tubing is generally hydraulically isolated by a packer that seals the production tubing/casing annulus.

A tubingless completion is one in which relatively small-diameter production casing is used to produce the well without the need for production tubing. The advantage of such completions is economic in that it may save five to six days rig time. Operations such as running and cementing liner, wellbore cleanup and packer setting procedures are eliminated.

After running the production casing into the wellbore, and prior to performing the cement job, it may be necessary to perform a pressure test of the casing string. There are three common methods by which this may be accomplished.

A plug may be run down the casing via slickline, after which the fluid between the surface and the plug is pressurized to the desired level. After the test, the plug is pulled out of the hole. The disadvantage of this technique is that the portion of casing below the plug is not tested.

A calibration plug may be used. In this method a first plug is circulated down the casing and it lands on a landing collar. The string can then be pressure tested. This is simple and reliable; however, to reestablish communication between the casing interior and the annulus, the pressure inside the string must be increased to a higher level to open a port (usually a burst disk). This operation may also be costly because of the rig time necessary to circulate the plug downhole.

A ball may be pumped. A ball seat is set in the casing string. When the ball lands, the string can be pressure tested. However, the ball must be sheared out at a higher pressure after the test, possibly compromising casing integrity.

SUMMARY

The Applicant discloses herein improved methods and apparatuses for pressure testing tubular bodies employed as production casing in a subterranean well.

In an aspect, embodiments relate to pressure-testing apparatuses comprising an activation-device seat, one or more bypass ports, a J-slot with an indexing pin and a spring. Such an apparatus may be installed inside a tubular body between a landing collar and float equipment. The tubular body may comprise drillpipe, casing or coiled tubing, and the activation device may be a ball, dart, bomb or canister. The float equipment may be a float shoe, or a float collar and a float shoe.

In a further aspect, embodiments relate to methods for pressure testing a tubular body inside the borehole of a subterranean well. The pressure-testing apparatus described above is installed inside the tubular body, between the float equipment at the bottom of the tubular body and below a landing collar inside the tubular body. The tubular body is then lowered into the wellbore. A process fluid is circulated down the tubular body and into the annulus between the tubular body and the wellbore wall. The process fluid may be drilling fluid, a completion fluid, spacer fluid or a chemical wash. An activation device, which may be a ball, dart, bomb or canister, is inserted into the process fluid, whereupon it lands and becomes lodged in the activation-device seat. Process fluid is pumped until the pressure inside the tubular body reaches the desired level. The pressurization of the tubular body causes the indexing pin to travel to the bottom of the J-slot. After the pressure test, process-fluid pumping ceases. The resulting pressure reduction inside the casing causes the indexing pin to travel to the top of the J-slot, which in turn releases the spring and opens the bypass ports. The opening of the bypass ports restores fluid communication between the casing interior and the annulus.

In yet a further aspect, embodiments relate to methods for cementing a subterranean well having a borehole. The pressure-testing apparatus described above is installed inside the tubular body, between the float equipment at the bottom of the tubular body and below a landing collar inside the tubular body. The tubular body is then lowered into the wellbore. A process fluid is circulated down the tubular body and into the annulus between the tubular body and the wellbore wall. The process fluid may be drilling fluid, a completion fluid, spacer fluid or a chemical wash. An activation device, which may be a ball, dart, bomb or canister, is inserted into the process fluid, whereupon it lands and becomes lodged in the activation-device seat. Process fluid is pumped until the pressure inside the tubular body reaches the desired level. The pressurization of the tubular body causes the indexing pin to travel to the bottom of the J-slot. After the pressure test, process-fluid pumping ceases. The resulting pressure reduction inside the casing causes the indexing pin to travel to the top of the J-slot, which in turn releases the spring and opens the bypass ports. The opening of the bypass ports restores fluid communication between the casing interior and the annulus, allowing the well operator to proceed with the cementing operation.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

At the outset, it should be noted that in the development of any such actual embodiment, numerous implementation—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary and this detailed description, each numerical value should be read once as modified by the term "about" (unless already expressly so modified), and then read again as not so modified unless otherwise indicated in context. Also, in the summary and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possessed knowledge of the entire range and all points within the range.

As discussed earlier, the present disclosure provides improved apparatuses and methods for pressure testing a tubular body. The tubular body is preferably one that is placed in the borehole of a subterranean well. The disclosure is also particularly aimed at (but not limited to) tubingless completions.

Figure 1A:
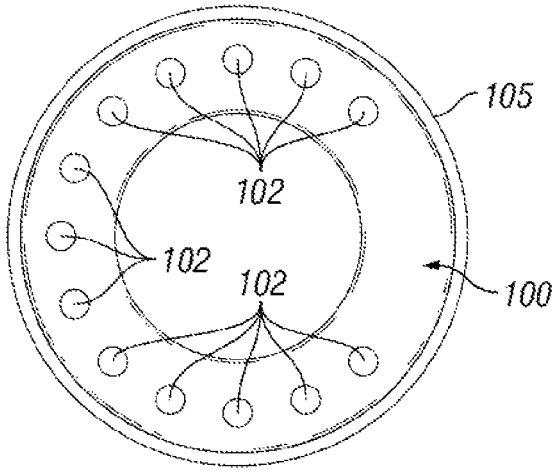
FIG. 1A presents a top view of a disclosed pressure-testing apparatus.
Figure 1B:
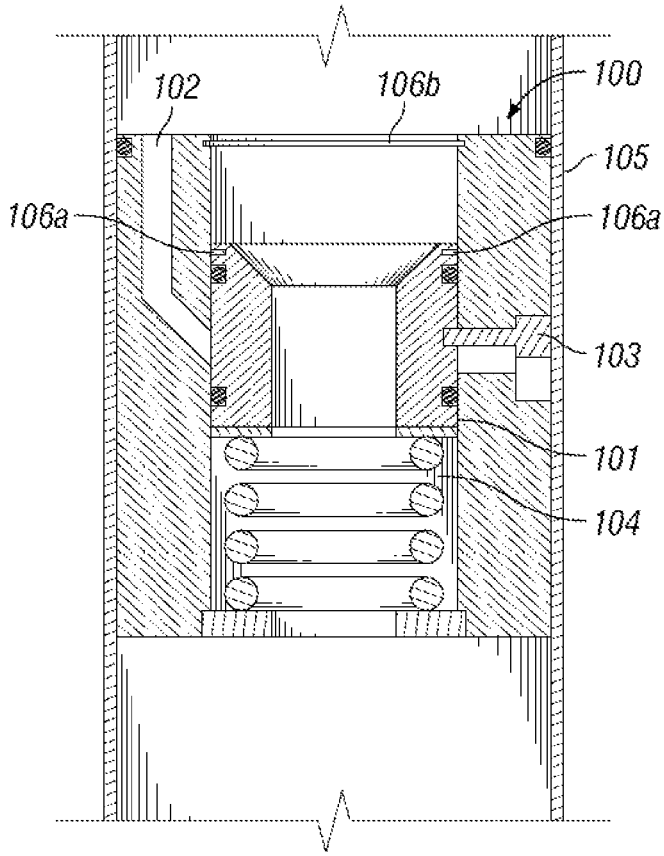
FIG. 1B presents a schematic diagram of a disclosed pressure testing apparatus.
Figure 2A:
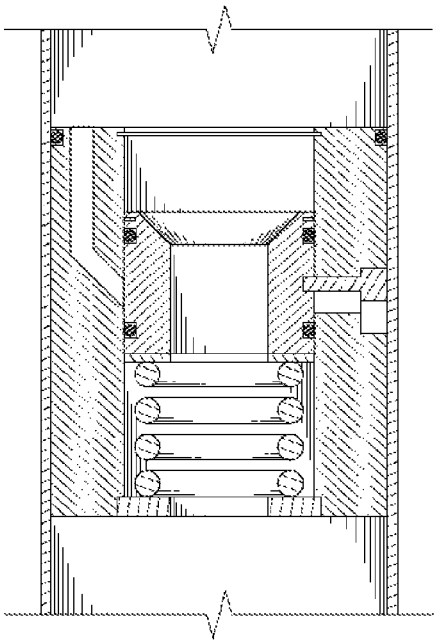
FIGS. 2A-2F illustrate the operation of a disclosed pressure-testing apparatus.
Figure 2B:
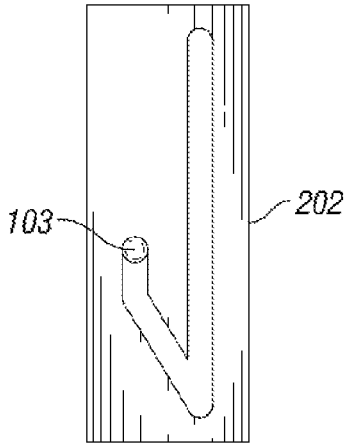
Figure 2C:
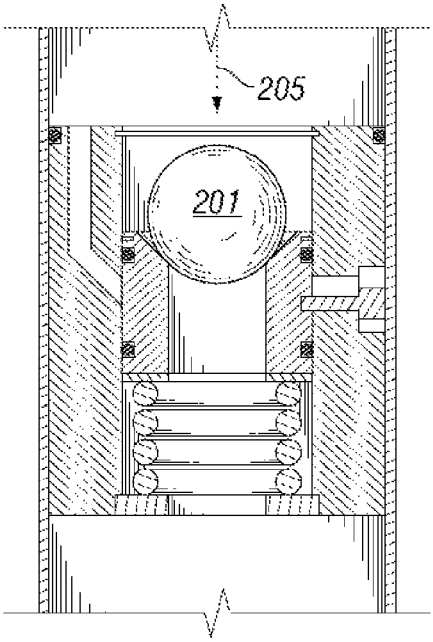
Figure 2D:
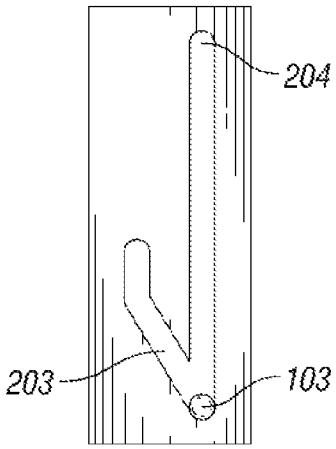
Figure 2E:
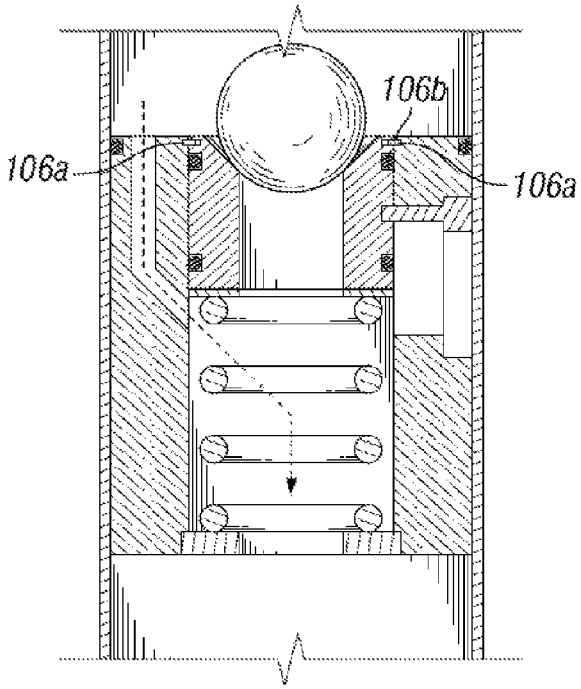
Figure 2F:
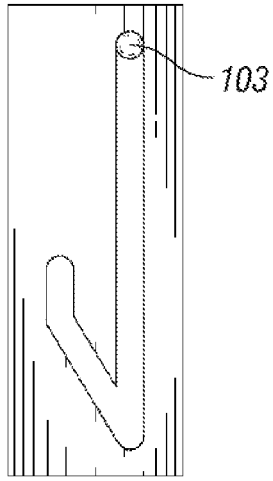
Figures 3A, 3B, 3C:
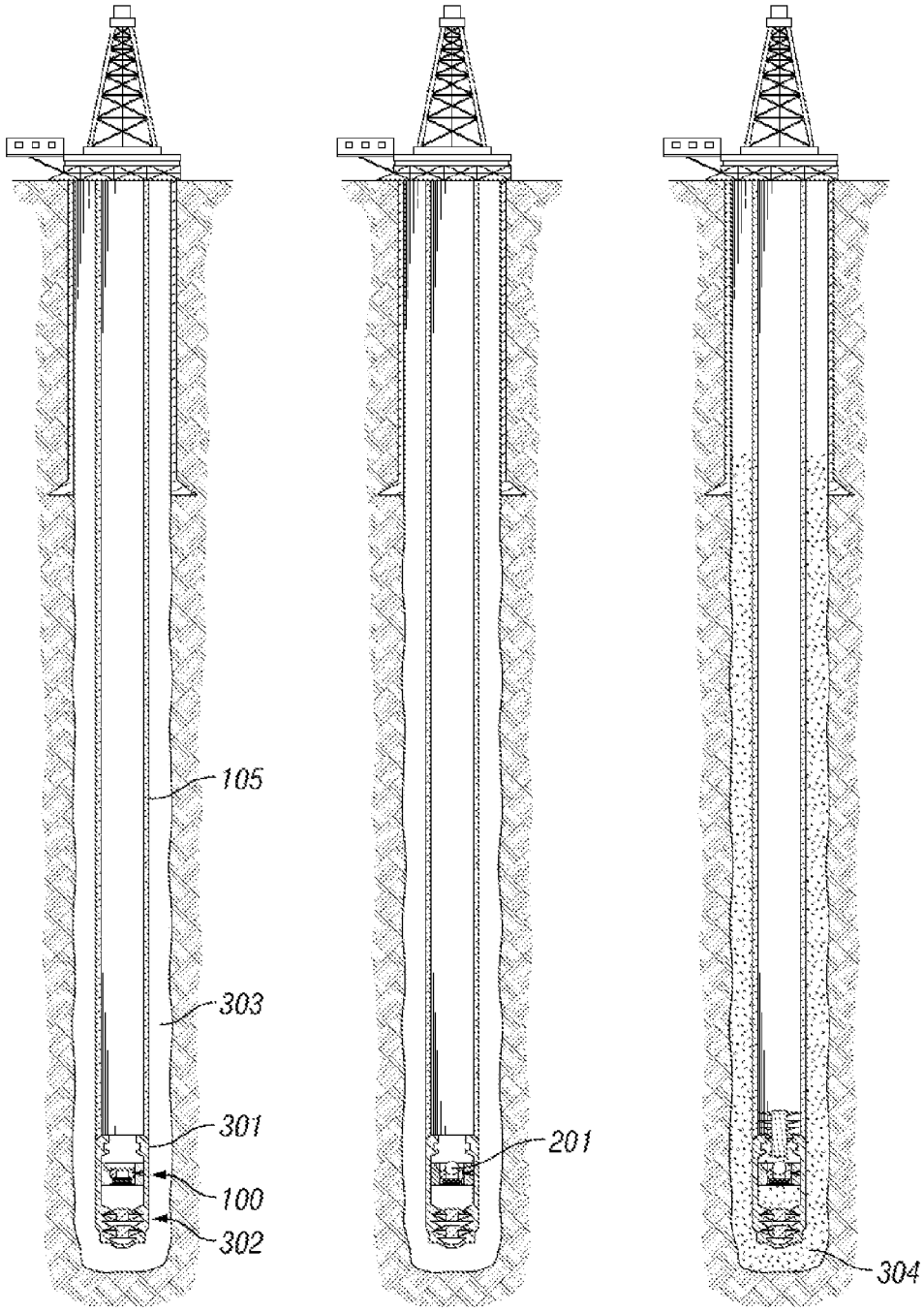
FIGS. 3A-3C illustrates a view of an operation of a disclosed pressure-testing apparatus inside the tubular body.

In an aspect, embodiments relate to apparatuses for pressure-testing. Schematic diagrams of the disclosed apparatus and its operation are shown in FIGS. 1-3. The apparatus 100 (Figs. 1A and 1B) comprises an activation-device seat 101, one or more bypass ports 102, a J-slot 202 (FIGS. 2B, 2D and 2F) with an indexing pin 103 and a spring 104. The apparatus may be installed inside a tubular body 105 between a landing collar 301 and float equipment 302 (FIGS. 3A-3C). The apparatus may further comprise a latch that may prevent downward movement of the spring after it expands. The latch consists of two portions, 106*a* and 106*b* (FIG. 1B).

Initially, the activation-device seat is open (FIG. 2A) and allows fluid communication between the tubular-body interior and the annulus 303. During a pressure test, an activation device 201 may be released into a process fluid and may land in the activation-device seat (FIG. 2C). The activation device blocks fluid communication between the tubular-body interior and the annulus. Downward pressure 205 may be applied by pressurizing the tubular-body interior with process fluid, causing the activation-device seat to move downward and the spring to compress. The resistance of the spring to compression may be preset according to the desired pressure to which the tubular body will be tested. As the spring compresses, the indexing pin in the J-slot also moves to the bottom position 203 (FIG. 2D). After the desired pressure has been attained, and downward pressure is reduced, the indexing pin in the J-slot moves to the top position 204 (FIG. 2E). This movement also allows the spring to expand sufficiently such that the activation-device seat may also move upward sufficiently to open the bypass ports. The opening of the bypass ports reestablishes fluid communication between the tubular-body interior and the annulus. The latch portion 106*a* becomes seated within the latch portion 106*b*, thereby preventing downward movement of the spring and the seat and keeping the bypass ports open (FIG. 2E).

The tubular body may comprise (but would not be limited to) drillpipe, casing or coiled tubing, and the activation device may be a ball, dart, bomb or canister. The float equipment may be a float shoe, or a float collar and a float shoe. The process fluid may be (but would not be limited to) drilling fluid, completion fluid, spacer fluid or a chemical wash. The activation device may be (but would not be limited to) a ball, a dart, a bomb or a canister.

A chemical substance may also be encapsulated within the activation device. At a desired time after deployment of the device into the process fluid, the chemical substance may be released into the process-fluid stream.

In a further aspect, embodiments relate to methods for pressure testing a tubular body inside the borehole of a subterranean well. The pressure-testing apparatus 100 described earlier may be installed inside a tubular body 105, thereby creating an annulus between the tubular-body exterior and the borehole. The apparatus is preferably located above float equipment 302 and below a landing collar 301. The tubular body may comprise drillpipe, casing or coiled tubing. The tubular body is then lowered into the borehole (FIG. 3A). Initially, the activation-device seat 101 is open and allows fluid communication between the tubular-body interior and the annulus 303; therefore, a process fluid may be circulated down the tubular-body interior and up the annulus. The process fluid may be (but would not be limited to) drilling fluid, completion fluid, spacer fluid or a chemical wash.

An activation device 201 may be inserted into the process fluid stream, and process-fluid circulation may continue until the activation device lands in the activation-device seat (FIGS. 2C and 3B). The activation device may be (but would not be limited to) a ball, a dart, a bomb or a canister. Upon landing in the activation-device seat, the activation device blocks fluid communication between the tubular-body interior and the annulus. Continued pumping of process fluid into the tubular-body interior pressurizes the casing. Process fluid is pumped until the pressure inside the tubular body reaches the desired level. During this step, the activation-device seat moves downward, compressing the spring 104 (FIG. 2C). At the same time, the indexing pin 103 moves to the bottom position 201 of the J-slot 202 (FIG. 2D). Next, process-fluid pumping stops, thereby releasing pressure within the tubular-body interior. The pressure reduction causes the activation-device to move upward, and the indexing pin moves to the top position 204 and the spring decompresses (FIGS. 2E and 2F). This upward movement unblocks the bypass ports 102, thereby reestablishing fluid communication between the tubular-body interior and the annulus, and allowing process-fluid to circulate again.

In yet a further aspect, embodiments relate to methods for cementing a subterranean well having a borehole. The pressure-testing apparatus 100 described earlier may be installed inside a tubular body 105, thereby creating an annulus between the tubular-body exterior and the borehole. The apparatus is preferably located above float equipment 302 and below a landing collar 301 (FIG. 3A). The tubular body may comprise drillpipe, casing or coiled tubing. The tubular body is then lowered into the borehole. Initially, the activation-device seat 101 is open and allows fluid communication between the tubular-body interior and the annulus 303; therefore, a process fluid may be circulated down the tubular-body interior and up the annulus. The process fluid may be (but would not be limited to) drilling fluid, completion fluid, spacer fluid or a chemical wash.

An activation device 201 may be inserted into the process fluid stream, and process-fluid circulation may continue until the activation device lands in the activation-device seat. The activation device may be (but would not be limited to) a ball, a dart, a bomb or a canister. Upon landing in the activation-device seat, the activation device blocks fluid communication between the tubular-body interior and the annulus. Continued pumping of process fluid into the tubular-body interior pressurizes the casing. Process fluid is pumped until the pressure inside the tubular body reaches the desired level. During this step, the activation-device seat moves downward, compressing the spring 104. At the same time, the indexing pin 103 moves to the bottom position 201 of the J-slot 202. Next, process-fluid pumping stops, thereby releasing pressure within the tubular-body interior. The pressure reduction causes the activation-device to move upward, and the indexing pin moves to the top position 204 and the spring decompresses. This upward movement unblocks the bypass ports 102, thereby reestablishing fluid communication between the tubular-body interior and the annulus, and allowing process-fluid to circulate again. Cement slurry 304 may then be pumped into and circulated in the well (FIG. 3C).

Those skilled in the art will appreciate that, at a later stage, the apparatus may be configured to be retrievable by, for example, slickline. Or, the apparatus may be milled out by, for example, a drilling apparatus mounted on coiled tubing. Such operations would restore full and unhindered access to the wellbore.

Although only a few example embodiments have been described in detail above, those skilled in the art will readily appreciate that many modifications are possible in the example embodiments without materially departing from this disclosure. Accordingly, all such modifications are intended to be included within the scope of this disclosure as defined in the following claims.

The invention claimed is:

1. An apparatus for pressure testing a tubular body, comprising:

(i) a valve body;

(ii) a seat for an activation device, the seat being located in the valve body, wherein movement of the seat within the valve body is limited by a spring whose resistance to compression may be preset according to a desired pressure to which the tubular body will be tested;

(iii) one or more bypass ports in the valve body, the ports being initially blocked by the seat;

(iv) a J-slot with an indexing pin located between the seat and the valve body, wherein the J-slot and indexing pin limit movement of the seat relative to the valve body; and (v) a latch that prevents movement of the spring after the seat has unblocked the bypass ports.

2. The apparatus of claim 1, wherein the apparatus is located inside the tubular body between a landing collar and float equipment.

3. The apparatus of claim 1, wherein the tubular body comprises drillpipe, casing or coiled tubing.

4. The apparatus of claim 1, wherein the activation device comprises a ball, a dart, a bomb or a canister.

5. The apparatus of claim 2, wherein the float equipment comprises a float shoe, or a float collar and a float shoe.

6. A method for pressure testing a tubular body inside the borehole of a subterranean well, comprising:

(i) installing a pressure-testing apparatus inside the tubular body, wherein the apparatus is located above float equipment at the bottom end of the tubular body, and below a landing collar inside the tubular body, wherein the pressure-testing apparatus comprises:

(a) a valve body;

(b) a seat for an activation device, the seat being located in the valve body, wherein movement of the seat within the valve body is limited by a spring whose resistance to compression may be preset according to a desired pressure to which the tubular body will be tested;

(c) one or more bypass ports in the valve body, the ports being initially blocked by the seat;

(d) a J-slot with an indexing pin located between the seat and the valve body, wherein the J-slot and indexing pin limit movement of the seat relative to the valve body; and (e) a latch that prevents movement of the spring after the seat has unblocked the bypass ports;

(ii) installing the tubular body in the borehole, thereby creating an annulus between the tubular-body exterior and the borehole;

(iii) circulating a process fluid through the tubular-body interior and the annulus;

(iv) inserting an activation device into the process-fluid stream;

(v) circulating process fluid until the activation device lands and become lodged in the activation-device seat;

(vi) pumping process fluid into the tubular-body interior until the pressure inside the tubular body reaches a desired level and the indexing pin moves to the bottom of the J-slot; and (vii) stopping process-fluid pumping and releasing the pressure inside the tubular body, causing the indexing pin to move to the top of the J-slot, thereby releasing the spring and opening the bypass ports.

7. The method of claim 6, wherein the tubular body comprises drillpipe, casing or coiled tubing.

8. The method of claim 6, wherein the activation device comprises a ball, a dart, a bomb or a canister.

9. The method of claim 6, wherein the float equipment comprises a float shoe, or a float collar and a float shoe.

10. The method of claim 6, wherein the apparatus further comprises a latch that prevents downward movement of the spring after the spring is released.

11. The method of claim 6, wherein the process fluid comprises drilling fluid, completion fluid, spacer fluid or a chemical wash fluid.

12. A method for cementing a subterranean well having a borehole, comprising:

(i) installing a pressure-testing apparatus inside the tubular body, wherein the apparatus is located above float equipment at the bottom end of the tubular body, and below a landing collar inside the tubular body, wherein the pressure-testing apparatus comprises:

(a) a valve body;

(b) a seat for an activation device, the seat being located in the valve body, wherein movement of the seat within the valve body is limited by a spring whose resistance to compression may be preset according to a desired pressure to which the tubular body will be tested;

(c) one or more bypass ports in the valve body, the ports being initially blocked by the seat;

(d) a J-slot with an indexing pin located between the seat and the valve body, wherein the J-slot and indexing pin limit movement of the seat relative to the valve body; and (e) a latch that prevents movement of the spring after the seat has unblocked the bypass ports;

(ii) installing the tubular body in the borehole, thereby creating an annulus between the tubular-body exterior and the borehole;

(iii) circulating a process fluid through the tubular-body interior and the annulus;

(iv) inserting an activation device into the process-fluid stream;

(v) circulating process fluid until the activation device lands and become lodged in the activation-device seat;

(vi) pumping process fluid into the tubular-body interior until the pressure inside the tubular body reaches a desired level, thereby causing the indexing pin in the J-slot to move to a bottom position; and (vii) stopping process-fluid pumping and releasing the pressure inside the tubular body, thereby causing the indexing pin in the J-slot to move to an upper position, thereby releasing the spring and opening the bypass ports; and (viii) pumping a cement slurry into the well.

13. The method of claim 12, wherein the tubular body comprises drillpipe, casing or coiled tubing.

14. The method of claim 12, wherein the activation device comprises a ball, a dart, a bomb or a canister.

15. The method of claim 12, wherein the float equipment comprises a float shoe, or a float collar and a float shoe.

16. The method of claim 12 wherein the apparatus further comprises a latch that prevents downward movement of the spring after the spring is released.

17. The method of claim 12, wherein the process fluid comprises drilling fluid, completion fluid, spacer fluid or a chemical wash fluid.

18. The method of claim 12, wherein a chemical substance is encapsulated within the activation device.

* * * * *